US011401086B2

(12) United States Patent
Austin et al.

(10) Patent No.: US 11,401,086 B2
(45) **Date of Patent: *Aug. 2, 2022**

(54) CONTAINER

(71) Applicant: Berry Plastics Corporation, Evansville, IN (US)

(72) Inventors: Kerry Austin, Evansville, IN (US); Tim L. Willett, Waverly, KY (US)

(73) Assignee: Berry Plastics Corporation, Evansville, IN (US)

( * ) Notice: Subject to any disclaimer, the term of this patent is extended or adjusted under 35 U.S.C. 154(b) by 188 days.

This patent is subject to a terminal disclaimer.

(21) Appl. No.: 16/737,118

(22) Filed: Jan. 8, 2020

(65) Prior Publication Data

US 2020/0140158 A1 May 7, 2020

Related U.S. Application Data

(63) Continuation of application No. 15/688,651, filed on Aug. 28, 2017, now Pat. No. 10,532,864.

(Continued)

(51) Int. Cl.
*B65D 50/04* (2006.01)
*B65D 43/16* (2006.01)

(Continued)

(52) U.S. Cl.
CPC ..... *B65D 50/046* (2013.01); *B65D 43/0208* (2013.01); *B65D 43/0218* (2013.01); *B65D 43/0249* (2013.01); *B65D 43/0268* (2013.01); *B65D 43/161* (2013.01); *B65D 43/164* (2013.01); *B65D 55/06* (2013.01); *B65D 2401/10* (2020.05); *B65D 2401/20* (2020.05); *B65D 2543/0062* (2013.01); *B65D 2543/00101* (2013.01); *B65D 2543/00296* (2013.01); *B65D 2543/00379* (2013.01);

(Continued)

(58) Field of Classification Search
CPC ..... B65D 50/046; B65D 43/161; B65D 43/0249; B65D 43/0268; B65D 43/164; B65D 43/0208; B65D 43/0218; B65D 55/06; B65D 2401/10; B65D 2401/20; B65D 2543/00296; B65D 2543/00796; B65D 2543/00731; B65D 2543/00101; B65D 2543/00379; B65D 2543/00685; B65D 2543/00509; B65D 2543/00537; B65D 2543/00555; B65D 2543/0062; B65D 2543/00629; B65D 2543/00694; B65D 2543/00768; B65D 2543/00805; B65D 2251/1025
USPC ..... 215/235, 237
See application file for complete search history.

(56) References Cited

U.S. PATENT DOCUMENTS 4,170,315 A 10/1979 Dubach
4,666,068 A * 5/1987 Bush ..... B65D 47/0885 222/546

(Continued)

OTHER PUBLICATIONS

Extended European Search Report for European App. No. 17844565.6 dated Apr. 6, 2020, BP-521 EP ||, 10 pages.

(Continued)

*Primary Examiner* — James N Smalley
(74) *Attorney, Agent, or Firm* — Barnes & Thornburg LLP

(57) ABSTRACT

A package includes a container and a lid. The container may include a tamper evident feature, a child resistant feature, or both.

20 Claims, 16 Drawing Sheets

Related U.S. Application Data

(60) Provisional application No. 62/380,094, filed on Aug. 26, 2016.

(51) Int. Cl.
*B65D 43/02* (2006.01)
*B65D 55/06* (2006.01)

(52) U.S. Cl.
CPC ..... *B65D 2543/00509* (2013.01); *B65D 2543/00537* (2013.01); *B65D 2543/00555* (2013.01); *B65D 2543/00629* (2013.01); *B65D 2543/00685* (2013.01); *B65D 2543/00694* (2013.01); *B65D 2543/00731* (2013.01); *B65D 2543/00768* (2013.01); *B65D 2543/00796* (2013.01); *B65D 2543/00805* (2013.01)

(56) References Cited

U.S. PATENT DOCUMENTS

| | | | | |
|---|---|---|---|---|
| 4,746,008 | A | 5/1988 | Heverly | |
| 5,027,969 | A | 7/1991 | Lesquir | |
| 5,083,671 | A * | 1/1992 | Hayes | B65D 50/061 215/245 |
| 5,137,260 | A | 8/1992 | Pehr | |
| 5,219,100 | A | 6/1993 | Beck | |
| 7,861,873 | B1 * | 1/2011 | Bragg | B65D 50/046 215/237 |
| 8,292,101 | B1 | 10/2012 | Bragg | |
| 8,925,755 | B2 | 1/2015 | Lesquir | |
| 9,561,880 | B2 | 2/2017 | Luburic | |
| 10,322,856 | B2 * | 6/2019 | Giraud | B65D 43/162 |
| 10,781,019 | B2 * | 9/2020 | Morris, Jr. | B65D 50/067 |
| 2005/0023285 | A1 | 2/2005 | Keung | |
| 2006/0186077 | A1 | 8/2006 | Robinson | |
| 2011/0024421 | A1 | 2/2011 | Luburic | |
| 2012/0211493 | A1 | 8/2012 | Daggett | |
| 2013/0177937 | A1 | 7/2013 | Brown | |
| 2013/0186897 | A1 | 7/2013 | Luburic | |
| 2015/0366755 | A1 * | 12/2015 | Milante | B65D 43/0218 215/203 |
| 2018/0273258 | A1 | 9/2018 | Luburic | |
| 2019/0062009 | A1 | 2/2019 | Georgiadis | |

OTHER PUBLICATIONS

International (PCT) Search Report and Written Opinion for PCT/US17/48936, dated Nov. 16, 2017, BP-521 PCT ||, 7 pages.

Office Action dated Apr. 3, 2019 for U.S. Appl. No. 15/688,651 (pp. 1-11).

Extended European Search Report for European App. No. 17844565.6 dated May 6, 2022, BP-521 EP || , 4 pages.

* cited by examiner

CONTAINER

PRIORITY CLAIM

This application is a continuation of U.S. application Ser. No. 15/688,651, filed Aug. 28, 2017, which claims priority under 35 U.S.C. § 119(e) to U.S. Provisional Application No. 62/380,094, filed Aug. 26, 2016, each of which is expressly incorporated by reference herein.

BACKGROUND

The present disclosure relates to a container, and particularly to a package including a container and a lid. More particularly, the present disclosure related to a package including a container and an openable and re-closable lid. More particularly, the present disclosure relates to a package.

SUMMARY

According to the present disclosure, a package comprises a container formed to include a product-storage region, a lid, and a collar. The lid and the collar cooperate via a locking or latching mechanism at one end to limit access to the product-storage region.

In illustrative embodiments, access to the interior of the container is controlled via a pair of actuatable tabs which move in a first direction to release the tabs from engagement with the collar and a second direction to open the lid. The tabs are formed to include locking apertures that engage with protrusions in the collar.

In illustrative embodiments, access is controlled via a removable strip that, upon removal, exposes the pair of actuatable tabs to be moved in the first direction. The removable strip is formed in a lower wall portion of the collar and includes weakened areas to facilitate removal.

In illustrative embodiments, the locking mechanism includes angled receiver segments formed in an upper collar wall that guide the actuatable tabs into the locked position when moving from an open position to a closed position.

Additional features of the present disclosure will become apparent to those skilled in the art upon consideration of illustrative embodiments exemplifying the best mode of carrying out the disclosure as presently perceived.

BRIEF DESCRIPTIONS OF THE DRAWINGS

The detailed description particularly refers to the accompanying figures in which.

DETAILED DESCRIPTION

Figure 1:
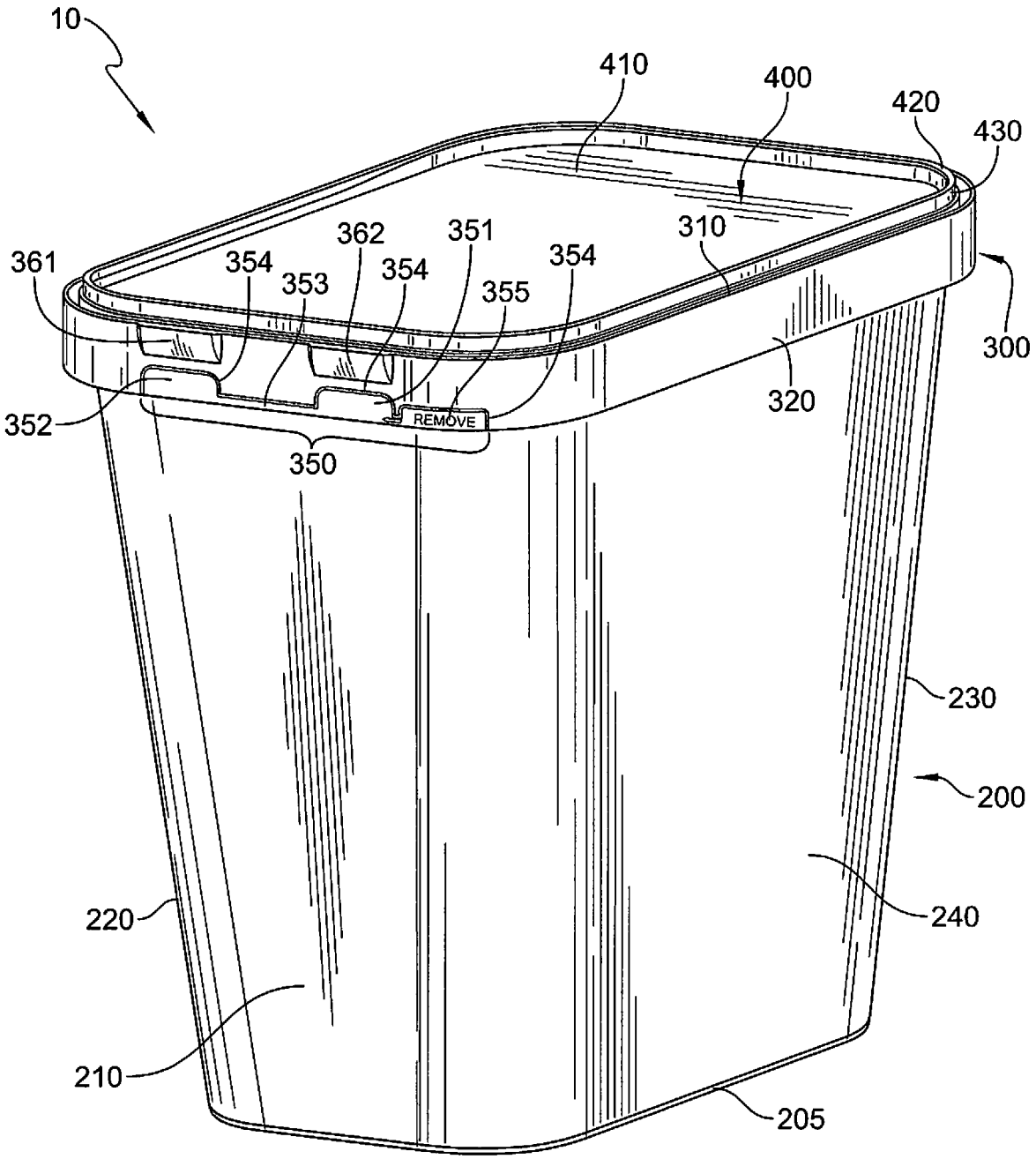
FIG. 1 is a perspective view of one embodiment of a package in accordance with the present disclosure showing that the package includes a container, a lid coupled to the container, and a strip that may be removed to allow opening of the lid.
Figure 2:
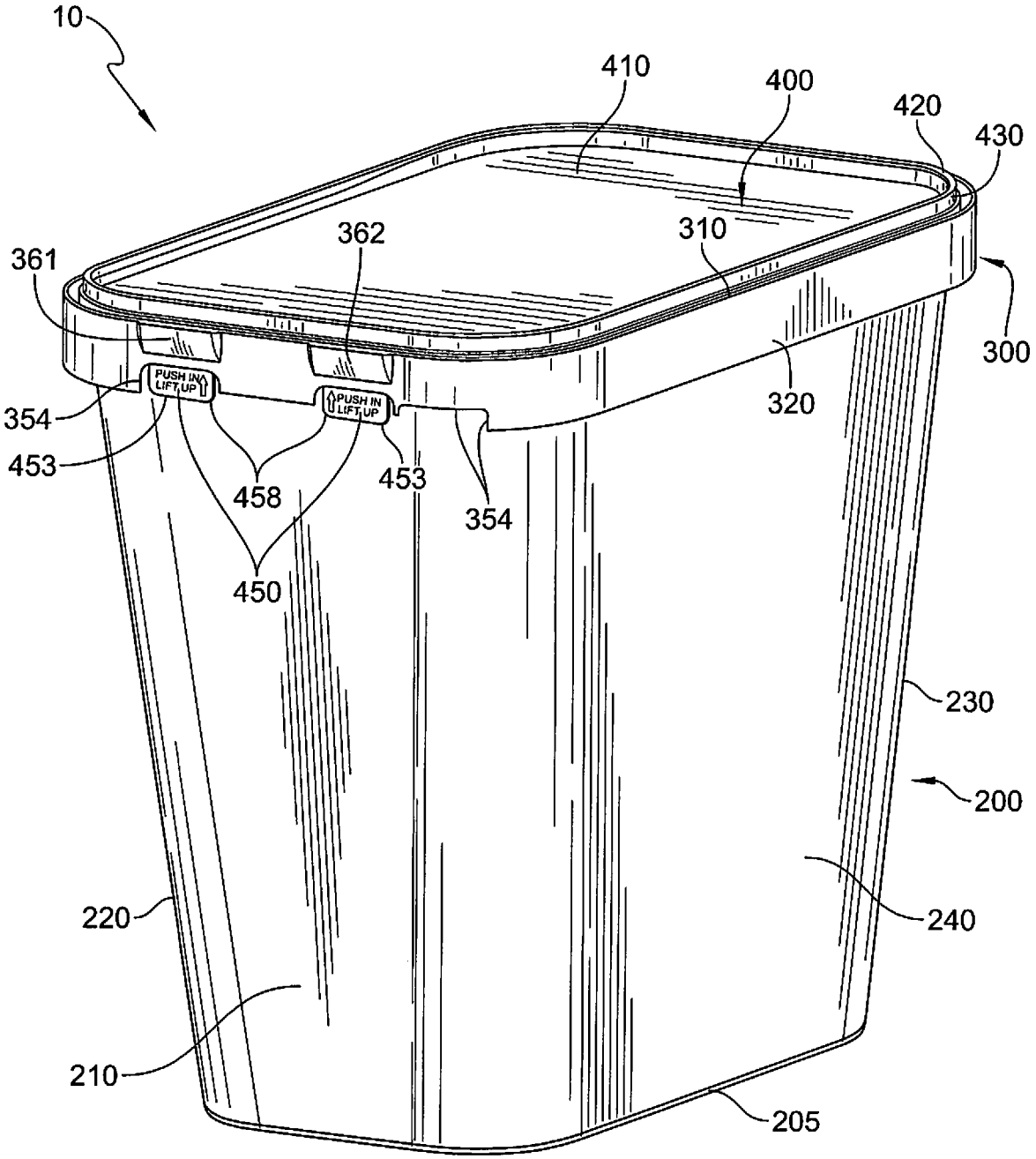
FIG. 2 is a view similar to FIG. 1 showing the strip removed to allow access to a pair of actuatable tabs that may be actuated to allow opening of the lid.
Figure 3:
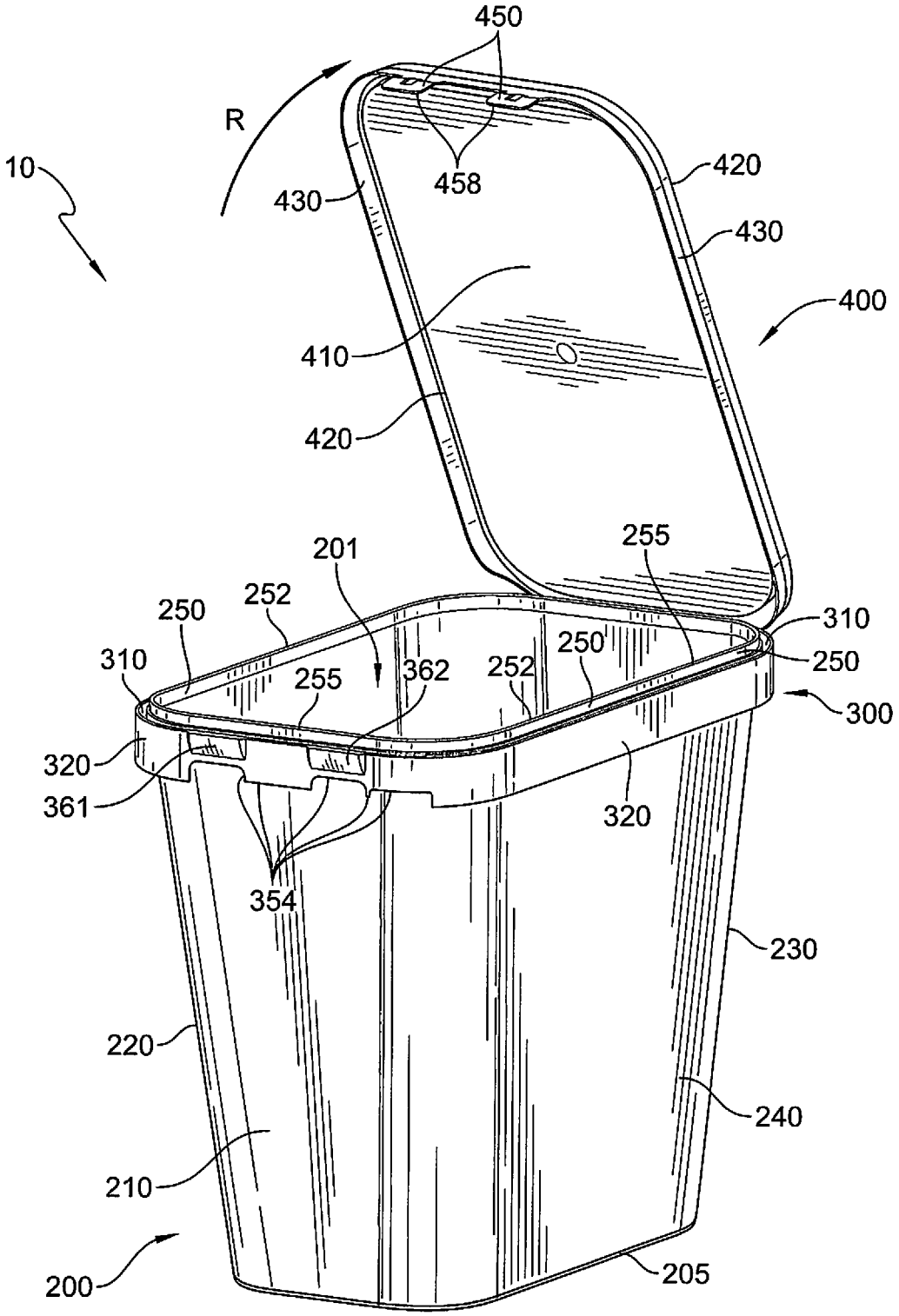
FIG. 3 is a view similar to FIG. 2 showing the lid in an open position.

Referring to FIGS. 1-3, some embodiments of a package or container 10 may include any or all of a body 200, collar 300, and lid 400. If included, lid 400 may attach to body 200 and/or collar 300 so as to close an opening 201 formed in the container 10 and arranged to open into an interior region of body 200 formed by any or all of a bottom 205, a first side 210, a second side 220, a third side 230, and a fourth side 240. Opening 201 may be substantially defined by a rim 250 and/or a collar 300. The interior region of body 200 may be suitable for containing, protecting, shipping, and/or storing products or contents. Body 200 and/or lid 400 may be used to store any of a variety of contents or products, including but not limited to, solid contents, liquid contents, gaseous contents, any other type of contents, or any combination thereof. For example, in some embodiments, container or package 10 or any portion thereof may be suitable for storing household goods such as cleaning agents. Package 10 or any portion thereof may be used to store, for further example, dishwashing pods, laundry pods, and/or similar items.

In some embodiments, container 10 or any portion thereof may be provided in such a way as to be resistant to opening by a child, such as, for example, by inclusion of a child-resistant feature such as one or more tabs 450. Moreover, in these or other embodiments, container 10 or any portion thereof may be provided in such a way that it provides evidence when contents stored therein have been tampered with and/or accessed, such as, for example, by inclusion of a tamper-evident feature such as a tamper-evident strip 350. Thus, in some embodiments of package 10, child-resistant or tamper-evident features, or both, may be provided.

In some embodiments, for example as shown in FIG. 1, a tamper-evident strip 350 may include a grip 355, a first tab cover 351, a second tab cover 352, a connecting strip 353, and/or a break line 354. A user may grasp grip 355 and pull or actuate it to break it or remove it from collar 300. Break line 354 may facilitate removing tamper-evident strip 350 by providing an area of relative structural weakness as compared to the rest of tamper-evident strip 350 and/or collar 300. In some embodiments, break line 354 may be an area of thinner material, perforated, scored, otherwise made easier to tear or break, and/or any combination thereof. Break line 354 may substantially form a border around or surround the remaining portions of tamper-evident strip 350 and facilitate removal of tamper-evident strip 350 from collar 300 and/or body 200 by providing a convenient and/or substantially continuous or intermittent break area. A user may, if desired, and if tamper-evident strip 350 is included, grab or hold onto grip 355 and pull it or otherwise remove it from collar 300. The user may continue pulling, thereby separating first tab cover 351, connecting strip 353, and second tab cover 352.

Removal of tamper-evident strip 350 may reveal one or more tabs 450 as shown in FIG. 2. Tabs 450 may, in some embodiments, be actuated to open lid 400. Optionally, one or more receivers such as first receiver 361 and second receiver 362 may be included, for example in collar 300, to facilitate reclosing lid 400 by providing an area for tabs 450 to enter and engage collar 300. First receiver 361 and/or second receiver 362 may be angled to provide a bias force to urge a tab 450 inward as lid 400 is closed. The angled receivers 361, 362 may provide a convenient latching or locking mechanism to maintain lid 400 in a closed position.

In some embodiments, tab 450 may be pushed inwardly to disengage collar 300. Tab 450 may then be lifted upwardly to open lid 400 once disengaged from collar 300. Tab 450 may include one or more surfaces 458 which may provide a location for a user to push in tab 450 to actuate it.

Lid 400 may be moved relative to body 200 to establish an open position as shown in FIG. 3. Lid 400 may be configured in an open position by rotating lid 400 relative to body 200 such as by a rotational motion R. Lid 400 may have a lid rim 420 that may be sized and shaped to cooperate with a body rim 250. In some embodiments, lid rim 420 and body rim 250 may cooperate to form a snap fit, friction fit, and/or a substantially sealed fit. Such a fit or fits may serve any of a variety of purposes, such as, for example, sealing the contents contained in container 10 to preserve or prolong the life of the contents, or to encourage lid 400 to remain in a closed position relative to body 200 until subjected to a sufficient rotational motion R, or both. Body rim 250 may have a feature such as a bead 255 to help form a snap fit, friction fit, and/or sealed fit between body 200 and lid 400. For example, bead 255 may provide extra thickness at a desired location on body rim 250, such as at body rim top end 252. Bead 255 may help to form a snap fit or friction fit with, for example, lid rim 420.

Lid rim 420 may substantially surround or form a border around lid cover 410 such as illustrated in FIG. 3. Lid cover 410 may substantially cover opening 201 to substantially enclose the interior region of body 200 when lid 400 is in a closed position. Lid 400 optionally may include a lid skirt 430, which may extend downwardly and/or outwardly away from lid rim 420. If included, lid skirt 430 may serve any of a variety of purposes, including, but not limited to, providing additional sealing, additional coverage of opening 201, aesthetics, adding structural support to lid 400, and/or engaging any or all of collar 300 to help encourage lid 400 to remain in a closed position and/or an open position.

In some embodiments, collar 300 may have an upper wall 310, a lower wall 320, and/or a landing 330. If included, landing 330 may extend outwardly 332 from body 200, such as at body rim 250, or any or all of body side walls 210, 220, 230, 240, toward the substantially vertically extending upper wall 310 and/or lower wall 320. Upper wall 310 may form a channel 334 with body rim 250 into which lid skirt 430 may extend when lid 400 is in a closed position. Landing 330 or a portion thereof may, optionally, be sized and shaped to mate or engage with lid skirt 430 to, for example, form a more secure fit between lid 400 and body 200 when lid 400 is in a closed position. Collar 300 may be lower on body 200, or nearer bottom 205, and if so, lid 400 and/or lid skirt 430 may be larger or extend further down to engage collar 300.

Figure 4:
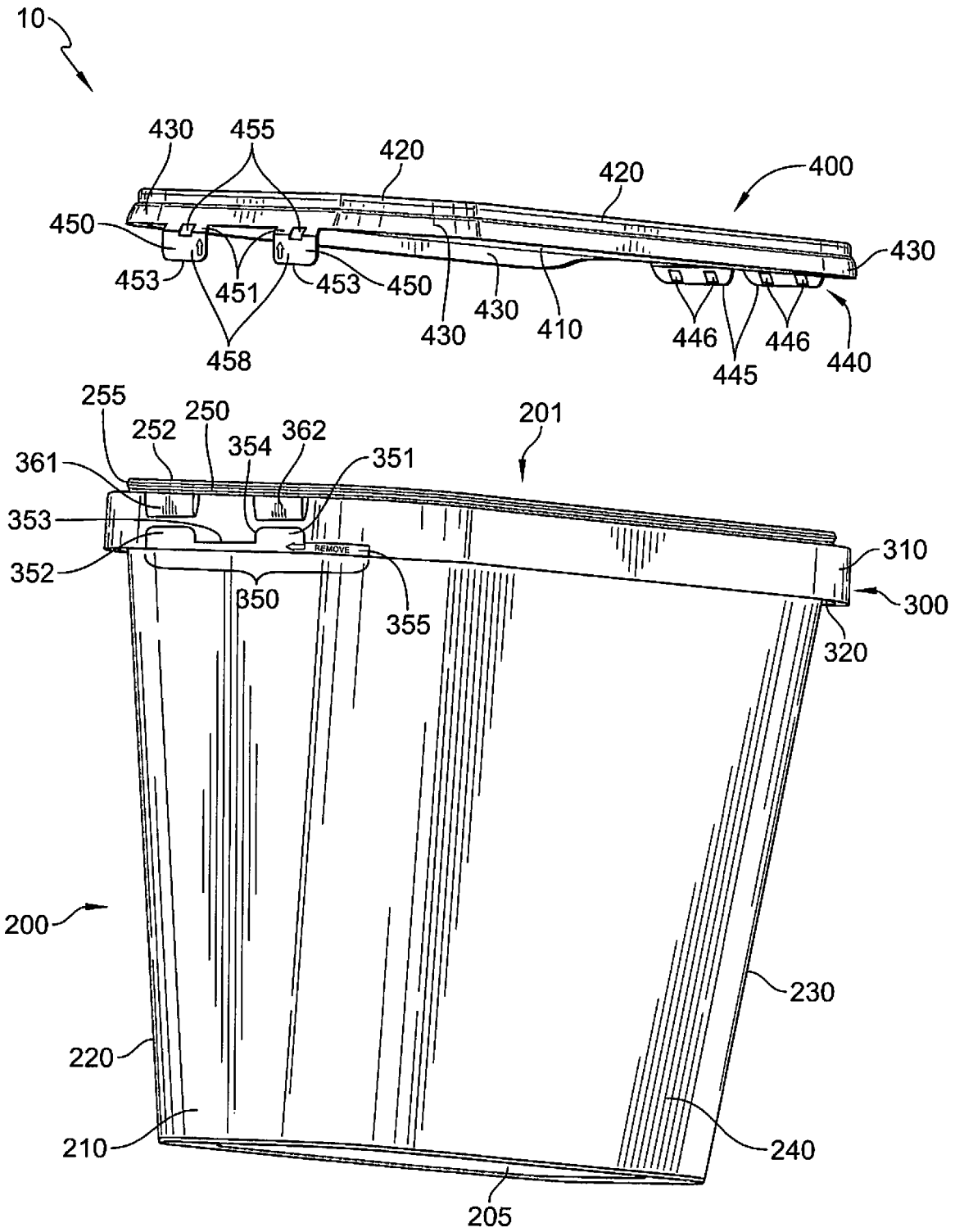
FIG. 4 is an exploded assembly view of the package of FIGS. 1-3 showing the lid separated from the container.

One embodiment of package 10 having body 200, collar 300, and lid 400 is illustrated, with lid 400 separated from body 200 in FIG. 4. Lid 400 may include a hinge 440, which may be located substantially opposite tab or tabs 450. In this embodiment, hinge 440 includes a pair of hinge extensions 445, each including a pair of hinge apertures 446. Hinge extension 445 may be deformable and/or include a portion that is deformable, for example, at or near where hinge extension 445 connects to or couples with lid 400, which may be at lid cover 410, lid rim 420, and/or lid skirt 430, to allow for rotational motion of lid 400 relative to some or all of hinge 440. In some embodiments, hinge extension 445 may snap onto or form a friction fit with a cooperating portion of body 200 or collar 300 to attach hinge 440 to body 200 and/or collar 300. While lid 400 is separated from body 200 and collar 300 in FIG. 4, lid 400 may be designed so as not to be detached from body 200, or, alternatively, hinge 440 and/or lid 400 may be removably attachable to body 200 and/or collar 300.

Figure 5:
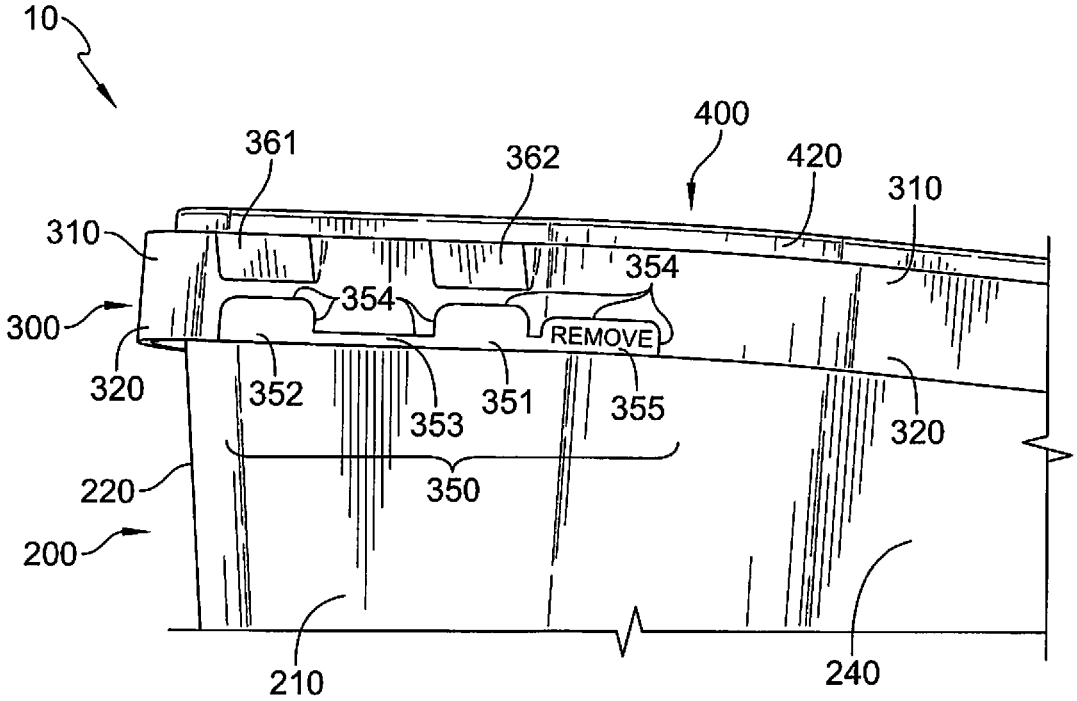
FIG. 5 is a partial perspective view showing a top portion of a container having a removable strip and a pair of channels formed in a collar to facilitate opening and closing of the lid.
Figure 6:
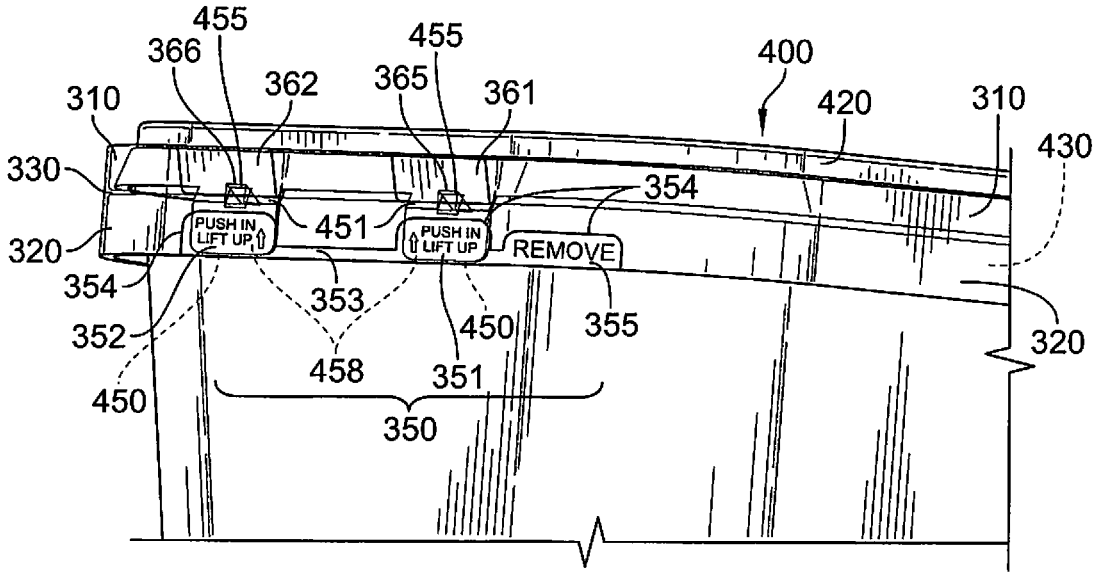
FIG. 6 is a view similar to FIG. 5 with portions of the container and collar partially transparent to show a pair of tabs that may be pushed in and lifted up to open the lid.
Figure 7:
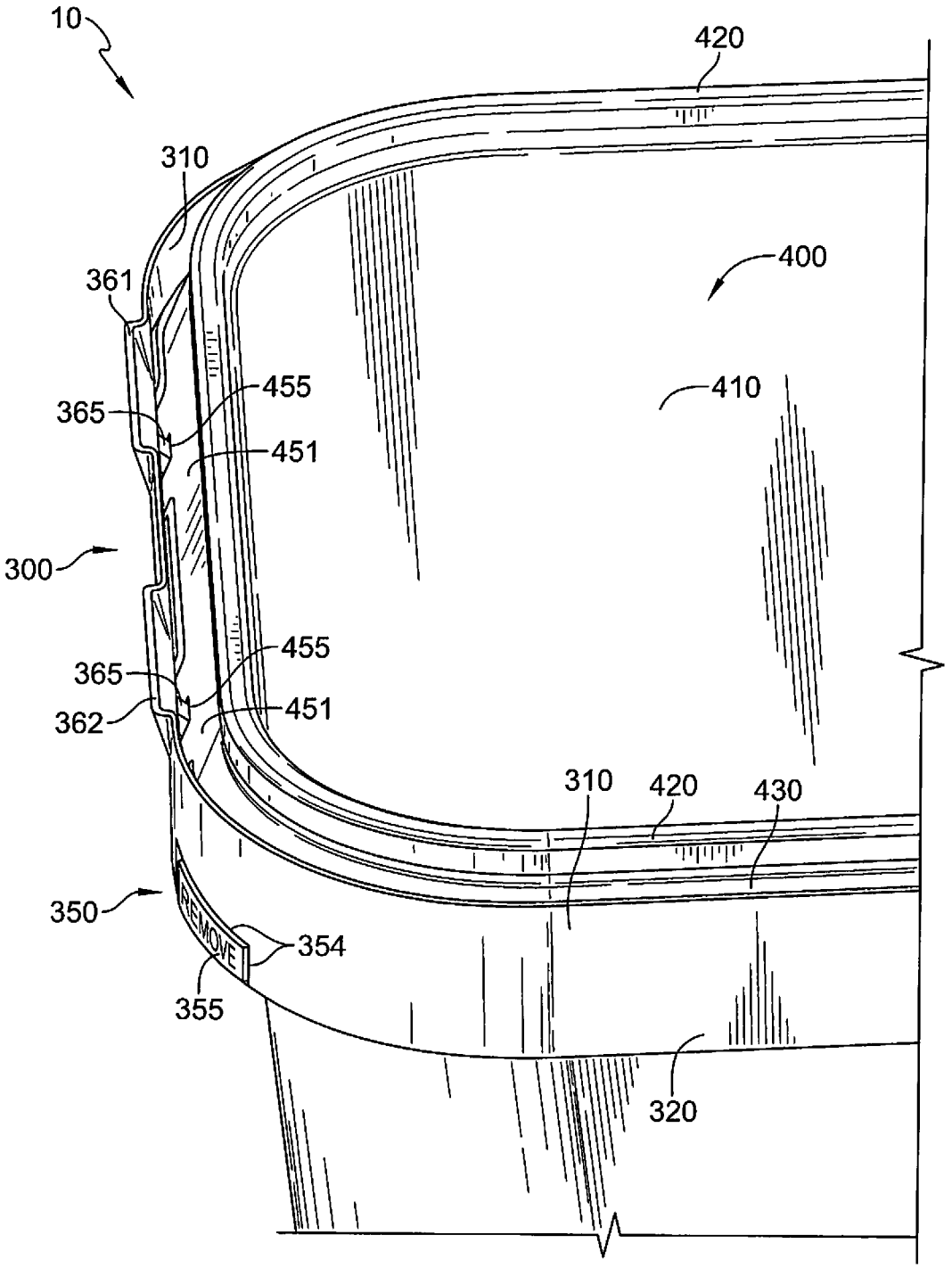
FIG. 7 is a partial top perspective view of the package of FIGS. 4 and 5 showing a portion of the container, collar, and lid.
Figure 8:
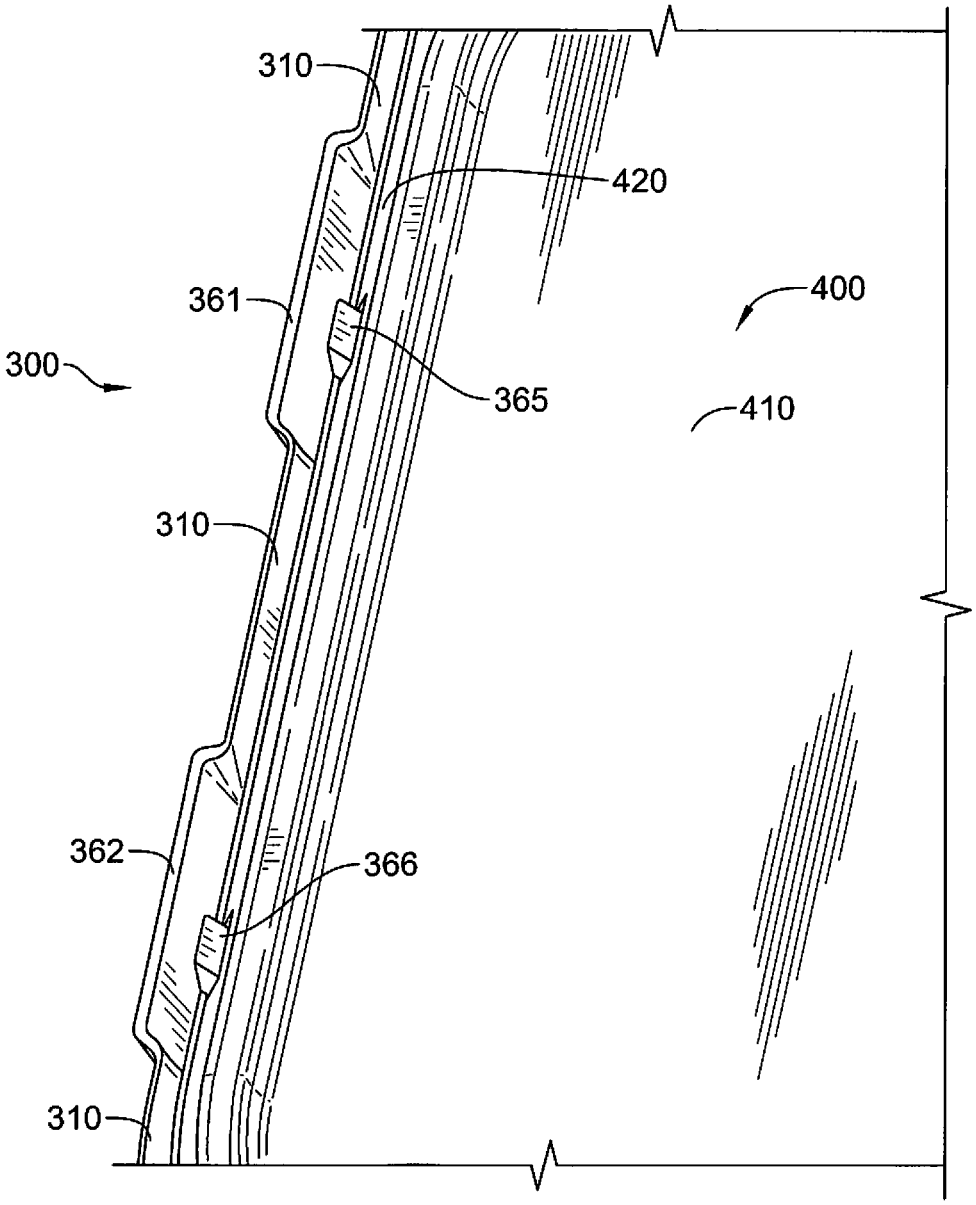
FIG. 8 is another top perspective view of the container of FIG. 7.
Figure 9:
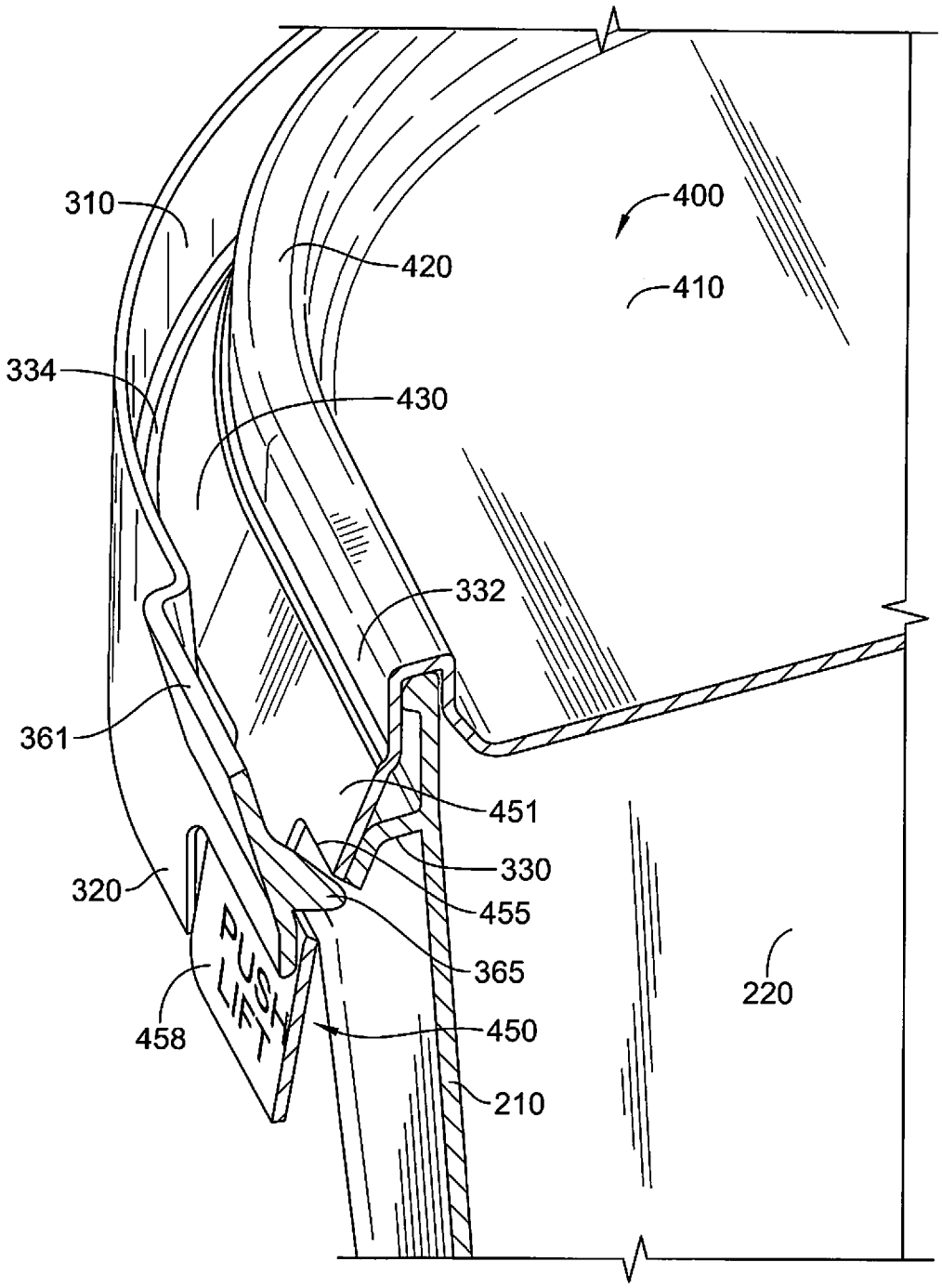
FIG. 9 is a partial perspective view of the container of FIGS. 7 and 8 with portions broken away.

Lid 400 is coupled to body 200 to close the opening when the lid is in the closed position as shown in FIG. 5. Tamper strip 350 is shown still attached to collar 300, which may, in some embodiments, indicate to a user that package or container 10 has not been opened or tampered with. FIG. 6 shows a similar view as FIG. 5, except in FIG. 6 body 200 and collar 300 are shown partially transparent so that underlying structure is visible. FIG. 6 illustrates first tab cover 351 of tamper strip 350 covering a tab 450 of lid 400. Similarly, second tab cover 352 is covering another tab 450. Additionally, tab aperture 455 on each tab 450 is shown engaged with a respective first locking protrusion 365 and a second locking protrusion 366, each of which is part of collar 300 and operates to engage a respective tab aperture 455 to maintain lid 400 in a closed position. Locking protrusions 365, 366 are illustrated in this embodiment as extending inwardly from an outer wall of collar 300, which may include upper wall 310, lower wall 320, or both. In this embodiment, when tabs 450 are actuated or pressed inwardly toward body 200, tab aperture 455 may likewise move inwardly a sufficient distance such that locking protrusions 365, 366 no longer extend into tab aperture 455, thus freeing lid 400 to open relative to collar 300.

Locking protrusions 365, 366 engage with and/or are at least partially inserted into tab apertures 455 as suggested in FIGS. 7-10. Tabs 450 may also include a top portion 451, which may attach to and/or be deformable relative to any or all of lid 400. In some embodiments, tab top(s) 451 may deform relative to lid 400 to allow rotational and/or translational motion of tab apertures 455 relative to locking protrusions 365, 366 to facilitate unlocking and opening of lid 400. In some embodiments, tab(s) 450 may provide a child resistant feature and/or may require at least two different types of motion to open, such as inwardly and upwardly relative to body 200.

FIGS. 7-10 also further illustrate receivers 361, 362. Receivers 361, 362 may be coupled with, connected to, and/or integral with collar 300 and/or body 200 and, if included, may facilitate closing lid 400 and/or receiving tabs 450 when lid 400 is being closed. For example, in embodiments including tab(s) 450 that extend downwardly and outwardly away from tab top 451 and/or lid 400, any or all receivers 361, 362 may have a sloped or angled design, being disposed further from lid 400 and/or opening 201 near the top, rim, or lid end of collar 300 or body 200 and angling inwardly and nearing body 200 as they progress away from the top, rim, or lid end of collar 300. Such an angled relationship of receiver(s) 361, 362 may facilitate closing and/or latching of lid 400 and/or tab(s) 450 by, for example, the sloped design of receiver(s) 361, 362 acting to gradually push, or bias, tab(s) 450 inwardly as tab(s) 450 are moved through receiver(s) 361, 362 while lid 400 is being closed so that closing the lid only requires an external force applied in a downward direction to the lid.

Figure 10:
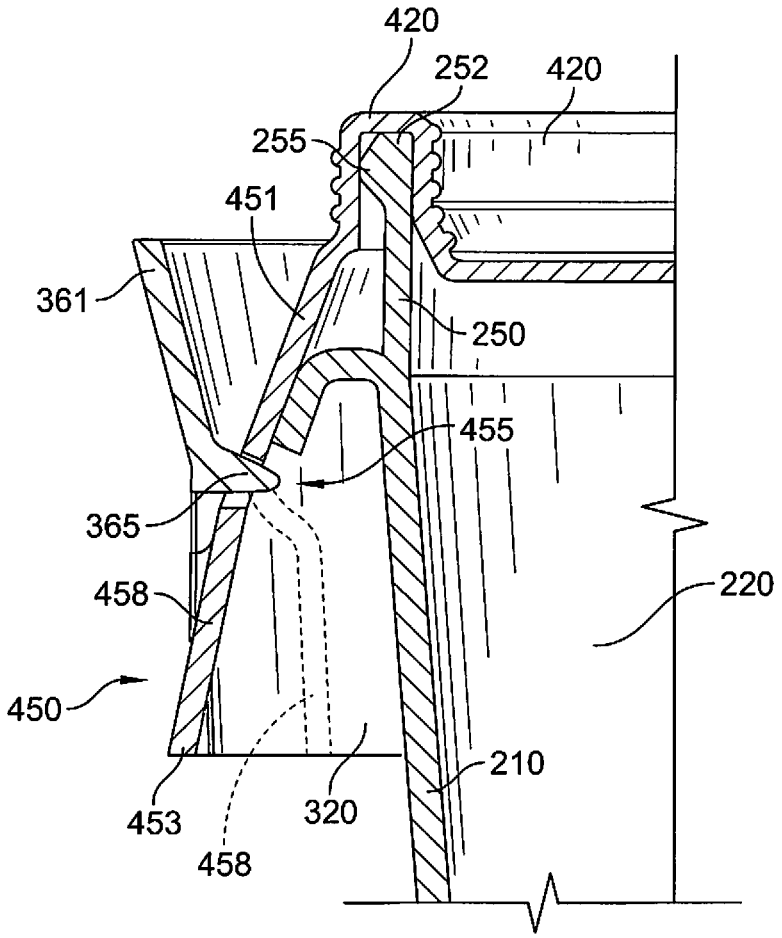
FIG. 10 is a partial front elevation view of a top section of the container of FIG. 9.

In some embodiments, there may be included a recess or relief in collar 300 below or opposite receiver(s) 361, 362 to allow tab(s) 450, 451 to return to a more outward orientation and allowing tab(s) 450 or any portion thereof to engage collar 300 or any portion thereof to form a lock, latch, and/or mechanical stop. When lid 400 and/or tab(s) 450 have been lowered or moved through receiver(s) 361, 362 a sufficient distance, tab aperture(s) 455, 456 may then substantially align with respective locking protrusions 365, 366. Tab(s) 450 may be deformable and/or formed of a deformable material to allow for movement relative to collar 300 and/or body 200 for any of a variety of reasons, including being releasably engageable with collar 300 and/or body 200 to form an actuatable locking and/or latching mechanism. FIG. 10 further illustrates in phantom how tab 450 may be pushed inwardly to disengage locking protrusion 365 of collar 300 from tab aperture 455, so that subsequent upward movement opens the lid 400.

While tab(s) 450 and collar 300 are generally illustrated in FIGS. 7-10 in a way that tabs 450 are operated by pushing in and pulling up, any of a variety of other operational directions may be used. For example, tabs 450 could be pushed in and pushed down. Alternatively, tabs 450 could be rotated, translated, slid, pressed, otherwise engaged or actuated, or any combination thereof. Moreover, there could be one tab 450, two tabs 450, or more than two tabs 450. Furthermore, tab 450 is not required to be included at all and, for example, a different type of actuating member may be used.

Further still, while tabs 450 are generally shown on the same side of collar 300 and/or body 200, they could be located on a different side, on different sides from one another, and/or at the corners of body 200 and/or collar 300. If tab(s) 450 are to be covered by a single tamper strip 350, the further tabs 450 are located from one another the longer tamper strip 350 may need to be, or alternatively, more than one tamper strip 350 may be used. More than one tamper strip 350 may be used in the embodiments depicted in the figures and/or in other embodiments. In exemplary embodiments, tamper strip 350 may be sufficiently rigid to resist inward deformation or moving in such a way as to engage and/or actuate tab(s) 450 to resist opening of lid 400 while tamper strip 350 is unremoved from collar 300 and/or body 200.

Figure 11:
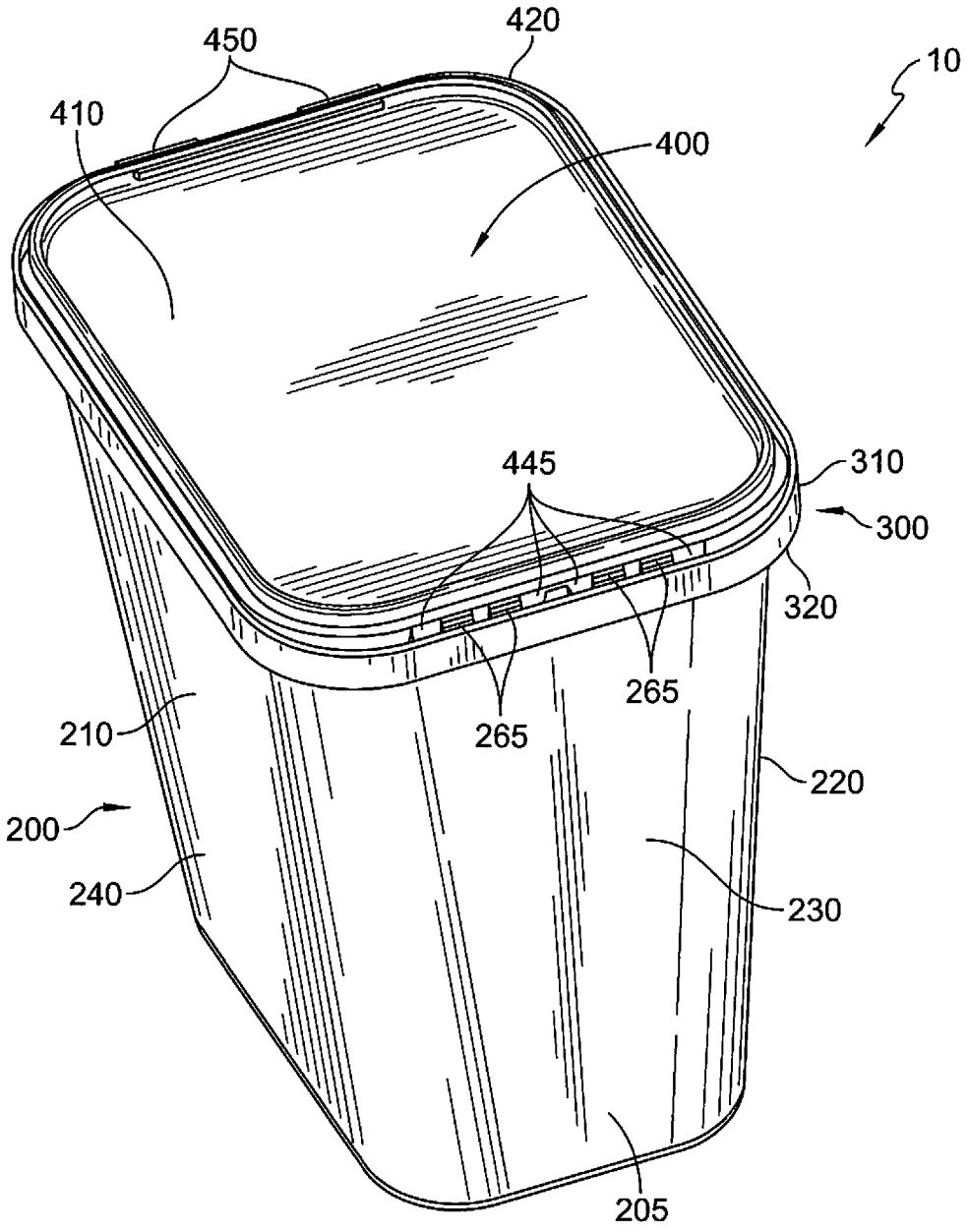
FIG. 11 is a rear perspective view of another embodiment of a package in accordance with the present disclosure showing a package including a container, a collar and a hinge.
Figure 12:
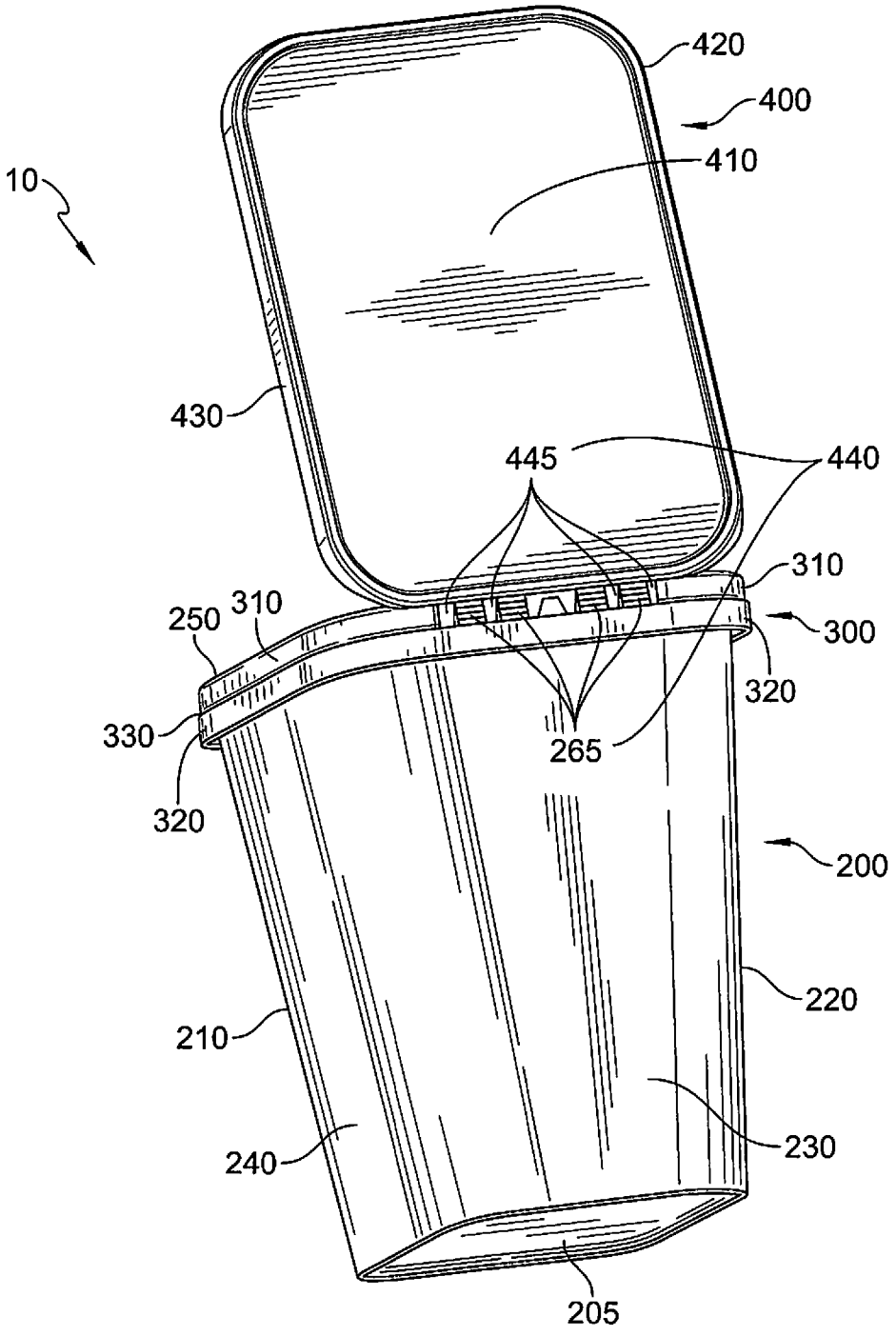
FIG. 12 is a view similar to FIG. 11 showing the lid in an open position.

FIGS. 11 and 12 further illustrate container 10 as shown from a rear perspective to show, among other things, a hinging mechanism formed between lid 400 and body 200 or collar 300. In these figures, body 200 and collar 300 are shown partially transparent to make the hinging mechanism and other features visible. Collar 300 and/or body 200 may include a cooperating portion of a hinge such as one or more body hinges 260 that may include a hinge protrusion 265. Lid 400 may include one or more hinge extensions 445 that may include one or more hinge apertures 446. Hinge protrusion(s) 265 may be sized, shaped, and/or configured to form a snap fit, friction fit, or other coupling mechanism with hinge aperture(s) 446 to allow coupling of lid 400 to body 200 and/or collar 300 while also providing the ability to move or rotate lid 400 relative to body 200 and/or collar 300.

Figure 13:
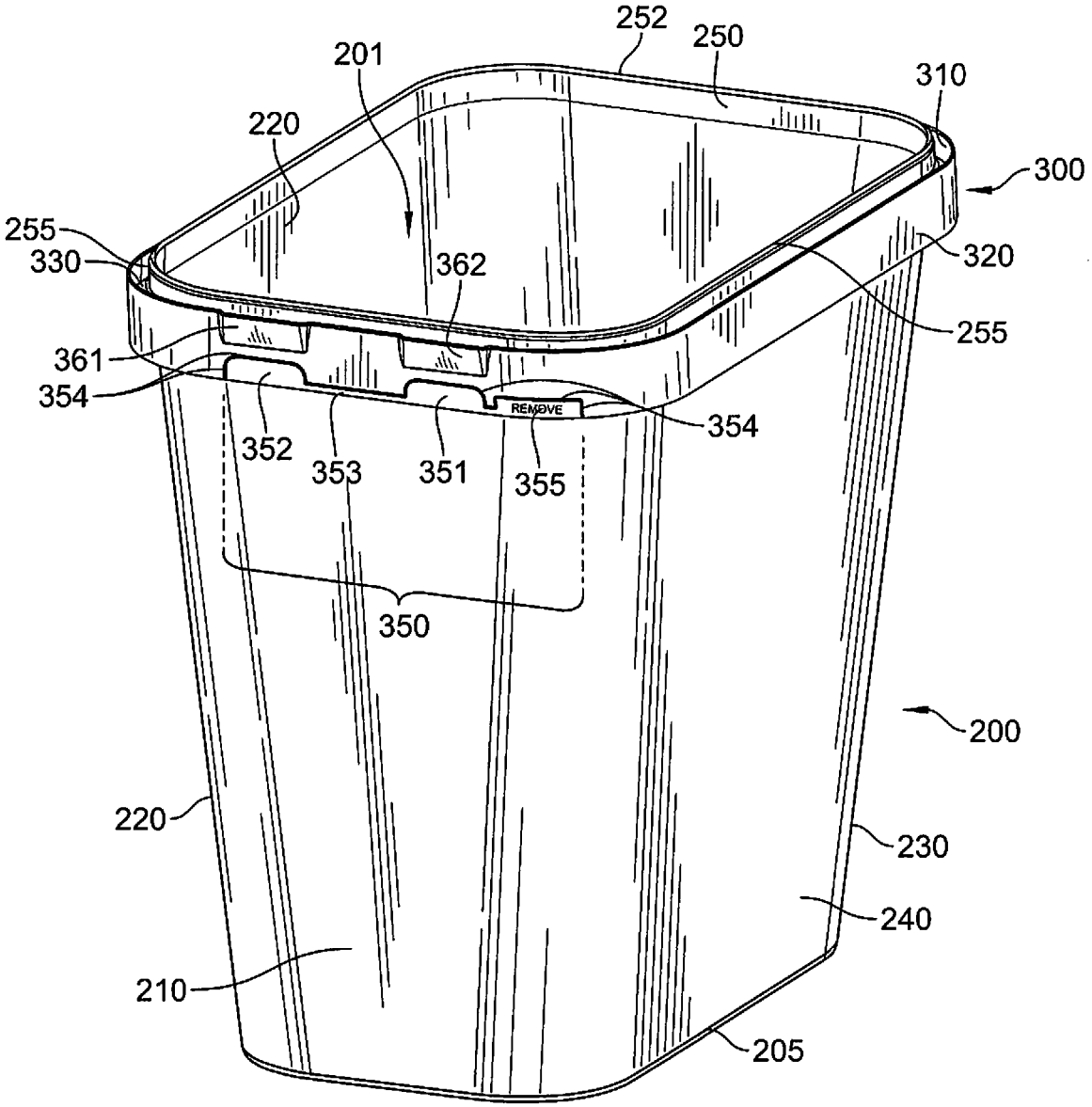
FIG. 13 is a front perspective view of a container including a body and a collar.
Figure 14:
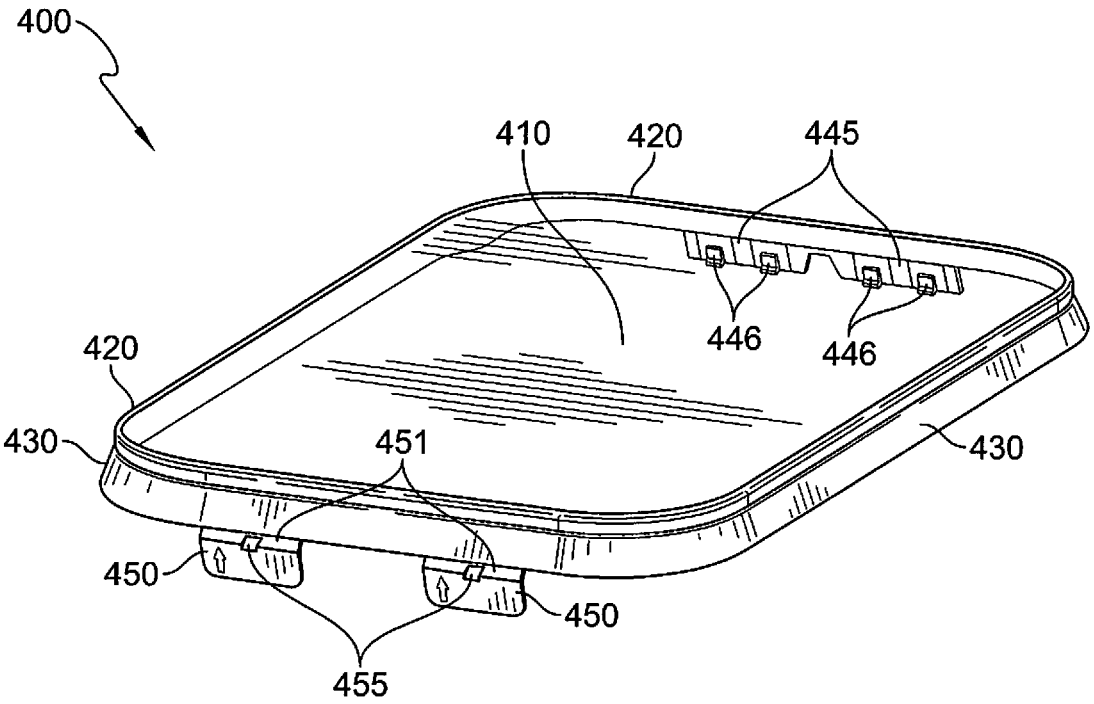
FIG. 14 is a front perspective view of a lid.
Figure 15:
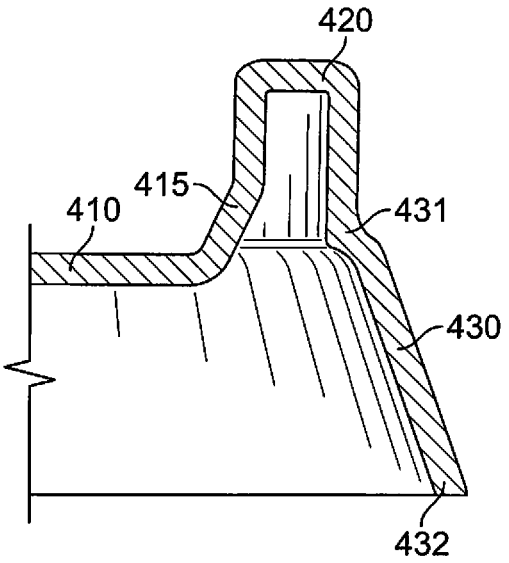
FIG. 15 is a partial sectional view taken of the lid, rim, and skirt of FIG. 14.
Figure 16:
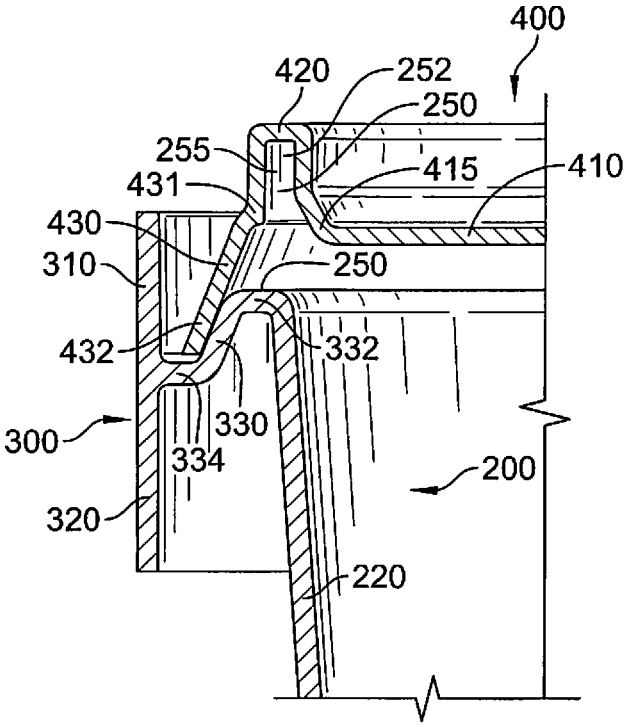
FIG. 16 is an elevational view of a portion of package with portions broken away to reveal the package includes a container, a collar, and a lid and the lid is in the closed position.

FIGS. 13 and 14 show lid 400 separated from body 200 and collar 300. Lid 400 may include a size, shape, geometry, and/or configuration to couple with, mate with, engage, attach to, and/or form a seal with a corresponding portion of body 200 such as body rim 250. In some exemplary embodiments, lid 400 may include rim 250 disposed between lid cover 410 and, if included, lid skirt 430. For example, lid rim 420 may substantially form a U-shape or V-shape channel into which some or all of body rim 250 may be inserted. Rim bead 455 may be sized, shaped, and/or configured, if included, to form a snap fit and/or friction fit with lid rim 420. Optionally, a lid cover angled portion 415 may be included to facilitate insertion of body rim 250 into lid rim 420, for example. If included, lid skirt 430 may be outwardly and/or downwardly angled away from lid rim 420 as lid skirt 430 extends from a first skirt end 431 to a second skirt end 432. Such an angled relationship of lid skirt 430 may facilitate insertion of body rim 250 into lid rim 420, for example.

Figure 17:
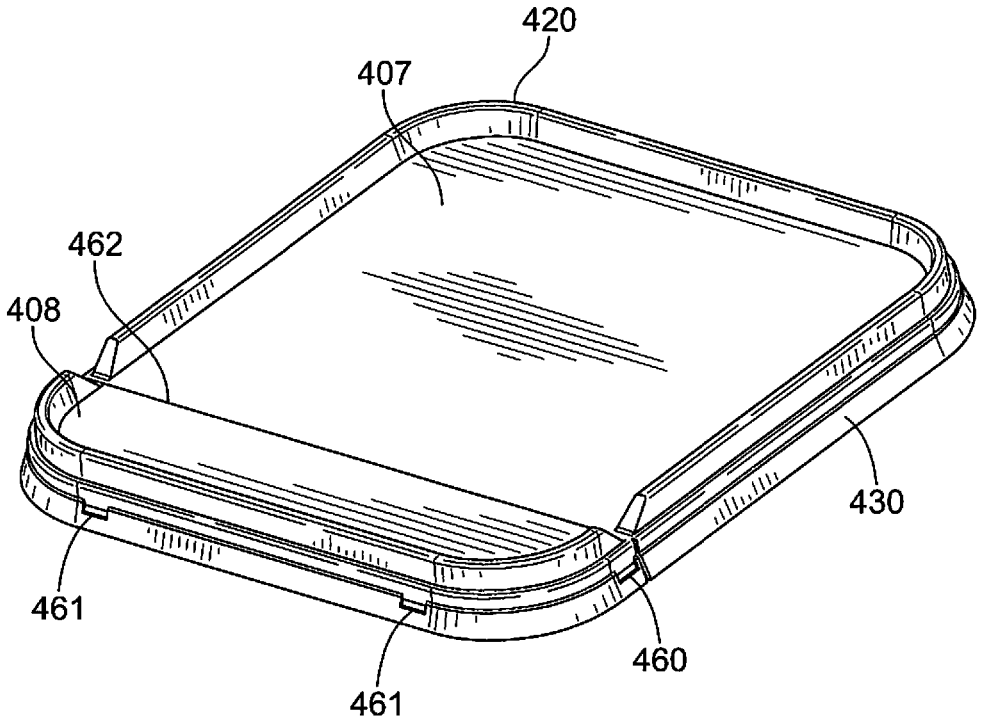
FIG. 17 is a front perspective view of a lid according to another embodiment with a front portion and a rear portion.

FIG. 17 illustrates an embodiment of a lid 400 separated from body 200 and collar 300. Lid 400 may include a front section 407 and rear section 408, separated by a hinge 462. As shown in FIG. 17, front section 407 is larger than rear section 408. However, rear section 408 may be larger than front section 407 or they may be about the same size. Rear section 408 includes a plurality of securement apertures 460, 461 formed in the lid skirt 430. According to the disclosed embodiment, one aperture 460 is formed in each side of the lid skirt 430 in the rear section, forming a pair of oppositely located securement apertures 460. Additionally, two apertures 461 are formed in the back portion of the lid skirt 430. Although four securement apertures 460, 461 are disclosed, more or fewer apertures may be used to secure the rear section 408 of the lid 410 to the container body as described further in FIG. 18. Locking or latching mechanism on the front section 407 is the same as the latching mechanism as described above.

Figure 18:
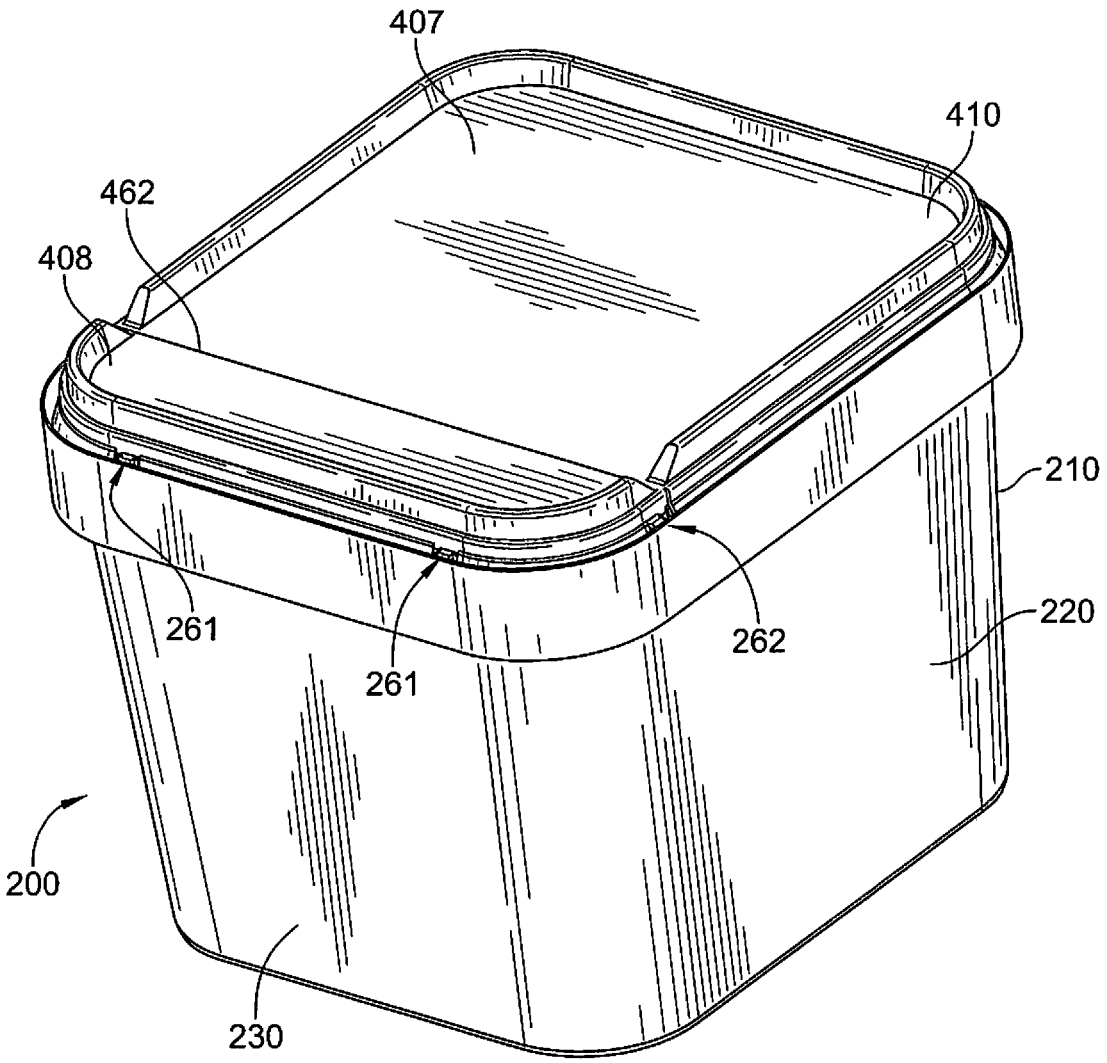
FIG. 18 is a view of the lid of FIG. 17 in a closed position with the container forming a package.

As seen in FIG. 18, securement apertures 460, 461 in the lid are sized and located to couple with respective securement projections 261, 262 formed in the rim 250, or sidewalls 220, 230, 240, of the container body 200. Securement projections(s) 261, 262 may be sized, shaped, and/or configured to form a snap fit, friction fit, or other coupling mechanism that provides fixed, non-moving securement of the rear portion 408 of lid 410 to the container body 200. When opening the lid 410, a user may push up on or lift tabs 450 once disengaged from collar 300 to cause rotational motion R of movable front portion 407 relative to body 200. In this embodiment, tabs 450 are formed in the front portion of the lid 407, so that front portion 407 rotates about hinge 462 relative to the stationary secured rear portion 408. In this embodiment in the lid open position, the front portion 407 of the lid opens while the rear portion 408 remains stationary and does not move relative to the container body 200.

Although the various figures illustrate package or container 10 as a substantially inverted truncated pyramid in shape, wider on the top than the bottom, with a substantially rectangular horizontal cross-sectional shape and rounded corners, container 10 and/or any component thereof may be any of a variety of shapes or sizes. For example, container 10 may be substantially cylindrical, tubular, triangular, spherical, polygonal, free form, truncated or non-truncated, wider on top, wider on bottom, varying width or depth along its height, width, or depth, or substantially uniform in height, width, or depth, container 10 may have rounded corners, angled corners, straight corners, or no corners. It is further understood that container or package 10 may be substantially rigid, substantially flexible, a hybrid of rigid and flexible, or any combination of rigid, flexible, and/or hybrid, such as having some areas be flexible and some rigid. For example, container or package 10 may be rigid near collar 300 and/or bottom 205, may include a substantially rigid frame with a flexible film or sleeve or the like around the frame, or both.

It is further understood that container 10 and/or any component thereof may be made of any of a variety of materials, including, but not limited to, any of a variety of suitable plastics material, any other material, or any combination thereof. Suitable plastics material may include, but is not limited to, polypropylene (PP), polystyrene (PS), polyethylene (PE), high-density polyethylene (HDPE), polyethylene terephthalate (PET), crystallized polyethylene terephthalate (CPET), mixtures and combinations thereof, or any other plastics material or any mixtures and combinations thereof. Multiple layers of material may be used for any of a variety of reasons, including to improve barrier properties, to reduce weight and/or lightweight, or to provide known functions related to multiple layer structures. The multiple layers, if included, may be of various materials, including those recited herein.

A variety of processes or combination thereof may be used to form container 10, any component thereof, or any layer or substrate used therein. For example, any component, layer, or substrate, or combination thereof, may be thermoformed, injection molded, blow molded, coextruded, subjected to any other suitable process, or subjected to any combination thereof. In some embodiments, container 10 and/or any component thereof may be formed substantially of injection molded PP. In some embodiments, container 10 and/or any component thereof may be formed of injection molded HDPE.

In an exemplary use of container 10, a user may be provided with container 10, the user may remove tamper strip 350 by grabbing hold of and pulling grip 355 and separating tamper strip 350 from collar 300 to reveal tabs 450. The user may then actuate tabs 450 to disengage tabs 450 from collar 300, wherein collar 300 may otherwise operate to inhibit or prevent vertical or rotational motion of lid 400 relative to collar 300 and/or body 200. To actuate tabs 450 in this way, a user may, for example, press tab press surfaces 458, which may be deformable to allow motion relative to collar 300. Continuing this example, a user may push up on or lift tabs 450 once disengaged from collar 300 to cause rotational motion R relative to body 200. Lid 400 may be rotated until opened to a desired opened position.

Storing of products or contents in a container or package will consolidate those products in one place and protect or prolong the life of the product. A lid that may be easily opened and closed to allow selectively access to the products in the package or container may be used. A child-resistant feature also may be selectively used to block or limit children or others from accessing the contents of the container, for example, if the contents are not intended for consumption.

In order to selectively block or impede access to the contents, containers have at times included a child-resistant feature or features to make it more difficult for a child, for example, to open the container. Some containers may include a child-resistant feature that is present the first time the container is opened as well as subsequent openings so that the protection continues as long as the container includes contents that are not intended to be consumed or ingested. A child-resistant feature or features that effectively block or limit children (i.e. individuals under the age of 14) from accessing the contents of the container, by making access more difficult for them while selectively allowing others to access the contents may be used.

A tamper-evident feature may communicate to a consumer, buyer, or potential buyer whether or not the package to be purchased and/or the contents therein have been opened or tampered with. In some embodiments, a tamper-evident feature may be included in a package with or without a child-resistant feature.

Certain embodiments according to the present disclosure provide a container or package that includes a body, a collar, and a lid. The lid may be openable and closable to selectively cover an opening into the body, which in turn may include a product storage region therein. The lid may engage a rim of the body to close the body as desired. The collar and/or the body may include one or more areas that may include a tamper-evident feature such as a tamper strip and/or an area that may include a child-resistant mechanism. In some embodiments, the lid may include one or more actuatable members that cooperate with the collar and/or the body to form a releasable latching or locking mechanism until actuated by a user. In this way, or in other ways, a user may disengage selectively the latch or lock to allow opening of the lid relative to the package or container body. In some embodiments, both a tamper-strip and a child-resistant mechanism may be used, and in some embodiments the tamper-evident strip may be removed to reveal the child-resistant mechanism.

In one aspect, for instance, some embodiments may provide a container that includes a body, a collar, and a lid. The body may form a product storage region. The lid may be coupled to the body and/or the collar and may be movable between an open position and a closed position. The collar may surround at least some of the rim, and/or the collar may include a side wall. The collar side wall may include a removable tamper-evident strip. The lid may include at least one actuatable member, such as a push tab for example, that may be accessible by hand when the tamper strip is removed from the collar. A latch may be formed between the actuatable member of the lid and a portion of the collar when the lid is in a closed position relative to the body. The actuatable member may be configured to receive a first user input in a first direction and a second user input in a second direction. The first user input may release the actuatable member from the collar allowing movement in the second direction. The second user input may move the lid from the closed position to the open position. The actuatable member may be configured relative to the portion of the collar to allow reforming the latch when the lid is moved from the open position to the closed position.

In some embodiments, the body may include a rim forming a perimeter around an opening into the container.

The collar may include an outwardly extending landing, an upper wall, and/or a lower wall. The lid may further include a skirt that is adjacent the outwardly extending landing when the lid is in the closed position. The tamper-evident strip may be formed in a portion of the collar lower wall. If included, the upper wall may include a receiver for the actuatable member of the lid.

In another aspect, some embodiments may provide a package that includes a body that includes a rim that surrounds and opens into a product storage region formed by the body. There may be a collar surrounding at least a portion of the rim and which includes a sidewall that includes a removable tamper-evident strip. There may be a lid coupled to the body or the collar and movable between an open position and a closed position, with the lid including at least one actuatable member that latches the lid when the lid is in the closed position. The actuatable member may be configured to receive a first user input in a first direction and a second user input in a second direction. The first user input may release the actuatable member from the collar allowing movement in the second direction. The second user input may move the lid from the closed position to the open position. The actuatable member may be configured relative to the portion of the collar to latch the lid when the lid moves from the open position to the closed position.

The invention claimed is:

1. A package comprising a container including a body that includes a rim that surrounds the body and opens into a product storage region formed by the body, a collar having a sidewall surrounding at least a portion of the rim and a locking protrusion that extends from the collar toward the body, a lid coupled to the body or the collar and movable between an open position and a closed position in which at least a portion of the lid blocks access to the product storage region, and a deformable tab attached to the lid, the deformable tab formed to an include an aperture through which the locking protrusion extends when the lid is in the closed position to form a locked position, wherein the deformable tab releasingly latches with the locking protrusion to provide the locked position in which the deformable tab engages the locking protrusion and is configured to release from the locking protrusion when subject to a first user input in a first direction, wherein the first user input releases the deformable tab and the locking protrusion to provide a released position, wherein the collar includes an outwardly extending landing engaged with the deformable tab above the aperture when the deformable tab is in the locked position and the released position to locate the outwardly extending landing vertically between the aperture and the rim of the container when the lid is in the closed position, wherein a second user input in a second direction is blocked when in the locked position and is permitted in the released position, and wherein the second user input in the second direction when in the released position moves the lid to the open position.

2. The package of claim 1, wherein the collar further comprises a sloped upper surface configured to deform the deformable tab inward toward the body and guide the aperture towards the locking protrusion when the lid is moved from the open position to the closed position.

3. The package of claim 1, wherein the first user input in the first direction comprises a first force on a bottom portion of the deformable tab toward the body to disengage the locking protrusion from the aperture and the second user input in the second direction is an upward force away from a bottom of the body.

4. A package comprising a container including a body that includes a rim that surrounds the body and opens into a product storage region formed by the body, a collar having a sidewall surrounding at least a portion of the rim and a locking protrusion that extends from the collar toward the body, a lid coupled to the body or the collar and movable between an open position and a closed position in which at least a portion of the lid blocks access to the product storage region, and a deformable tab attached to the lid, the deformable tab formed to an include an aperture through which the locking protrusion extends when the lid is in the closed position to form a locked position, wherein the deformable tab releasingly latches with the locking protrusion to provide the locked position in which the deformable tab engages the locking protrusion and is configured to release from the locking protrusion when subject to a first user input in a first direction, wherein the first user input releases the deformable tab and the locking protrusion to provide a released position, wherein the collar includes an outwardly extending landing engaged with the deformable tab when the deformable tab is in the locked position and the released position, wherein a second user input in a second direction is blocked when in the locked position and is permitted in the released position, wherein the second user input in the second direction when in the released position moves the lid to the open position, and wherein the collar further comprises a removable tamper evident strip located in a lower portion of the sidewall and exterior to at least a portion of the deformable tab.

5. The package of claim 4, wherein the tamper evident strip is formed in the sidewall of the collar and positioned to cover a portion of the deformable tab when the lid is in the closed position.

6. The package of claim 5, wherein the lid further comprises a second deformable tab and the tamper evident strip covers a portion of the second deformable tab.

7. The package of claim 6, wherein the tamper evident strip includes a grip, a first tab cover, a second tab cover, and a connecting strip interconnecting the first tab cover and the second tab cover, the first deformable tab covered entirely by the first tab cover when viewed from a front of the package and the second deformable tab covered entirely by the second tab cover when viewed from the front of the package, and wherein the first deformable tab and the second deformable tab are covered by the tamper evident strip until the tamper evident strip is removed from the collar.

8. The package of claim 1, wherein the first user input deforms the deformable tab in the first direction.

9. The package of claim 8, wherein the locking protrusion formed in the collar that forms a latch with the deformable tab is released when the first user input deforms the deformable tab in the first direction.

10. The package of claim 1, wherein the lid is coupled to one of the collar and the body by a hinge.

11. The package of claim 10, wherein the hinge includes at least one hinge protrusion coupled to one of the collar and the body and at least one hinge extension formed on the lid corresponding to at least one hinge protrusion, the at least one hinge extension being formed to include a corresponding hinge aperture that receives the at least one hinge protrusion to form the hinge.

12. The package of claim 1, wherein the collar comprises a second protrusion and the lid comprises a second deformable tab formed to include an aperture which is configured to receive the second locking protrusion therein to form the latch.

13. The package of claim 1, wherein the collar comprises a receiver in an upper wall of the collar and is configured to guide the deformable tab aperture towards the locking protrusion.

14. The package of claim 13, wherein the receiver is an angled receiver configured to bias the deformable tab towards the body of the container and guide the deformable tab towards the locking protrusion.

15. The package of claim 1, wherein the lid comprises a front rotatable portion and a rear stationary portion coupled to the front rotatable portion by a hinge, so that the front rotatable portion rotates about a hinge to the open position independent of the rear stationary portion while the rear stationary portion remains secured to the body in a fixed position.

16. A package comprising a container including a body that includes a rim that surrounds the body and opens into a product storage region formed by the body, a collar having a sidewall surrounding at least a portion of the rim and a locking protrusion that extends from the collar toward the body, a lid coupled to the body or the collar and movable between an open position and a closed position in which at least a portion of the lid blocks access to the product storage region, and a deformable tab attached to the lid, the deformable tab formed to an include an aperture through which the locking protrusion extends when the lid is in the closed position to form a locked position, wherein the deformable tab releasingly latches with the locking protrusion to provide the locked position in which the deformable tab engages the locking protrusion and is configured to release from the locking protrusion when subject to a first user input in a first direction, wherein the first user input releases the deformable tab from the locking protrusion to provide a released position, wherein the collar includes an outwardly extending landing engaged with the deformable tab when the deformable tab is in the released position, the outwardly extending landing located vertically between the locking protrusion and the rim of the container when the lid is in the closed position, wherein a second user input in a second direction is blocked when in the locked position and is permitted in the released position, wherein the second user input in the second direction when in the released position moves the lid to the open position, and wherein the first user input is applied to the deformable tab below the outwardly extending landing.

17. The package of claim 16, wherein the first user input in the first direction comprises a first force on a bottom portion of the deformable tab toward the body to disengage the locking protrusion from the aperture and the second user input in the second direction is an upward force away from a bottom of the body.

18. The package of claim 1, wherein the collar is coupled to the sidewall in a fixed position relative to the sidewall and wherein the outwardly extending landing is coupled to an outer surface of the sidewall and includes a first portion that extends horizontally away from the sidewall and a second portion that extends downwardly to define a space between the sidewall and the second portion.

19. The package of claim 1, wherein the outwardly extending landing has a convex outer surface relative to the deformable tab.

20. The package of claim 1, wherein the outwardly extending landing defines a pivot axis of the deformable tab in the closed position and the first direction causes the deformable tab to move about the pivot axis.

* * * * *